United States Patent [19]

Eaton et al.

[11] 4,231,421

[45] Nov. 4, 1980

[54] WOUND FIN HEAT EXCHANGER SUPPORT

[75] Inventors: Burrows P. Eaton, Camillus; William Wright, East Syracuse, both of N.Y.

[73] Assignee: Carrier Corporation, Syracuse, N.Y.

[21] Appl. No.: 965,622

[22] Filed: Dec. 1, 1978

[51] Int. Cl.[3] ..... F28F 9/00

[52] U.S. Cl. ..... 165/68; 165/76; 165/125; 165/172; 248/68 R

[58] Field of Search ..... 165/67, 68, 76, 125, 165/172, 162; 248/68 R

[56] References Cited

U.S. PATENT DOCUMENTS

| | | | |
|---|---|---|---|
| 2,458,159 | 1/1949 | Goldthwaite | 165/125 |
| 2,517,411 | 8/1950 | Patterson | 248/68 R |
| 2,560,436 | 7/1951 | Shears | 248/68 R |
| 2,613,900 | 10/1952 | Byrnie | 248/68 R |
| 2,980,404 | 4/1961 | Andersen et al. | 165/172 |
| 3,077,226 | 2/1963 | Matheny | 165/68 |
| 3,233,851 | 2/1966 | Lemieux et al. | 248/68 R |
| 3,544,049 | 12/1970 | Brown et al. | 248/68 R |
| 3,920,887 | 11/1975 | Klods et al. | 248/68 R |
| 3,934,645 | 1/1976 | Butts | 165/67 |
| 4,030,540 | 6/1977 | Roma | 165/172 |

FOREIGN PATENT DOCUMENTS

| | | | |
|---|---|---|---|
| 226749 | 9/1962 | Austria | 165/67 |
| 1040055 | 10/1958 | Fed. Rep. of Germany | 165/162 |

*Primary Examiner*—Sheldon Richter

*Attorney, Agent, or Firm*—J. Raymond Curtin; Robert P. Hayter

[57] ABSTRACT

Apparatus for use in a heat exchanger assembly having wound fin tubing including a spacer member having a structural portion for securing components within the heat exchanger and a series of spaced projections extending therefrom. The spaced projections define a series of U-shaped openings adapted to receive and maintain the wound fin tubing in a fixed relationship. A retainer element is mounted to enclose the openings to secure the wound fin tubing therein. On some of the projections of the spacer member are mounted tabs which are inserted through slots in the retainer element to secure the retainer element to the spacer member such that the wound fin tubing is secured within the spaced openings and such that the structural portion of the spacer member secures various components of the heat exchanger assembly.

3 Claims, 7 Drawing Figures

WOUND FIN HEAT EXCHANGER SUPPORT

BACKGROUND OF THE INVENTION

1. Field Of The Invention

The present invention relates to heat exchanger assemblies. More specifically the present invention relates to the combination of elements providing both an internal support for a heat exchanger and apparatus for maintaining wound fin tubing in an appropriate location.

2. Prior Art

Wound fin heat exchangers are well known in the refrigeration and air conditioning fields. A wound fin heat exchanger consists of a tube having fin material wrapped about the tube in heat exchange relation therewith to promote heat transfer between the fluid flowing through the tube and a separate fluid flowing over the tube. The utilization of this type of heat exchanger, wound fin, has been found to be both cost effective and to provide the appropriate amount of heat transfer with a minimum of tube length. A type of wound fin tubing includes slit fin tubing wherein a sheet of fin material is slit laterally and then rolled into a generally U shaped arrangement such that the non-slit portion is wound against the tube and the slit portions extend outwardly therefrom.

To make advantageous use of wound fin heat exchangers it is necessary that the heat exchanger be configured to optimize heat transfer. Once the appropriate configuration is ascertained the wound fin tubing should then be maintained in that configuration for the life of the heat exchanger.

There have been several methods used for mechanically securing heat exchange elements. However the prominent methods heretofore used in the air conditioning industry for securing adjacent coils of a wound fin heat exchanger include using adhesives or mechanically deforming the coil beyond the point of elasticity such that a new configuration is maintained.

The herein disclosed apparatus not only serves to provide a support which mechanically locates and secures wound fin tubing in a desired location but additionally acts as a structural element of the heat exchanger assembly.

SUMMARY OF THE INVENTION

It is an object of the present invention to provide apparatus for supporting wound fin tubing in an appropriate heat exchanger configuration.

It is another object of the present invention to structurally support a heat exchanger assembly while simultaneously maintaining a wound fin coil in the appropriate configuration.

It is yet another object of the present invention to provide apparatus for securing wound fin tubing within a heat exchanger assembly which is easy to manufacture and convenient to assemble.

It is a still further object of the present invention to provide a wound fin heat exchanger which maintains the appropriate spacing between passes of a cylindrical wound fin tube to promote high efficiency heat exchange.

It is a still further object of the present invention to provide a safe, economical, reliable and easy to install and manufacture support for use with wound fin tubing in a heat exchanger assembly.

Other objects will be apparent from the description to follow and the appended claims.

The above objects are achieved according to the preferred embodiment of the invention by the combination of a spacer member and a retainer element. The spacer member has a structural portion for providing strength to the heat exchanger assembly and having extending therefrom a series of spaced projections, extending from the structural portion, the projections forming generally U-shaped openings for the receipt of wound fin tubing. From at least one of these projections a tabular member extends for interlocking with the retainer element. The retainer element is provided to cover the U-shaped openings once the tubes are inserted therein such that the tubes are maintained in fixed relationship to each other within the openings. The retainer element has slots formed therein through which the tabs extending from the spacer member may be inserted. Once inserted the tabs may be mechanically deformed to secure the retainer element to the spacer member and at the same time to secure the wound fin tubes within the openings defined by the projections extending from the spacer member.

DESCRIPTION OF THE PREFERRED EMBODIMENT

The embodiment as described herein is adapted for use in a heat exchanger assembly having a base and a top cover supported in relation to each other by the support described. The spacer member is shown securing wound fin tubing having one circuit in a cylindrical configuration. The support will be equally applicable to wound fin heat exchangers in configurations other than cylindrical, to wound fin heat exchangers having multiple circuits and to wound fin heat exchangers wherein other structural apparatus is provided to support the other components of the heat exchanger assembly.

Figure 1:
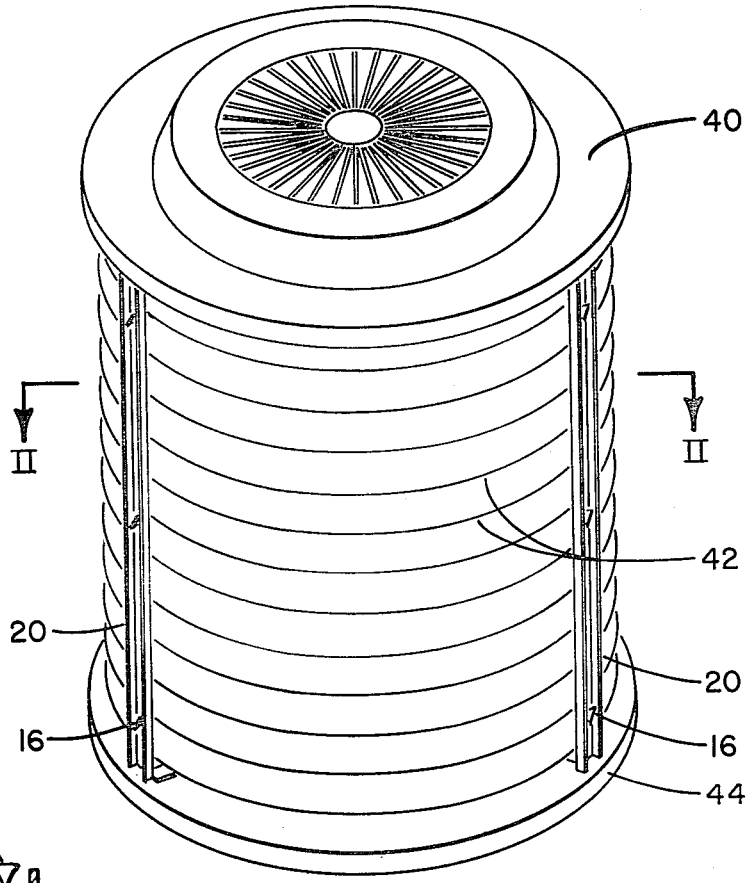
FIG. 1 is a perspective view of a partial heat exchanger assembly having wound fin tubing and the support as described herein.
Figure 7:
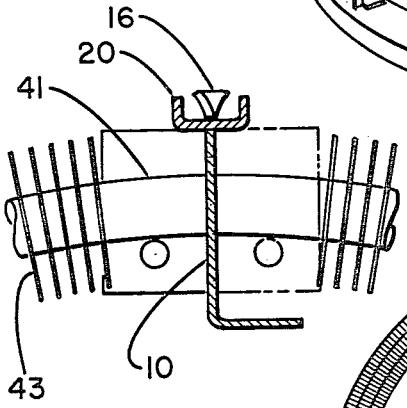
FIG. 7 is an enlarged view of that portion of FIG. 2 enclosed in the circle designated A.

Referring to FIG. 1 there can be seen a partial assembly of the wound fin heat exchanger with the top cover 40 and base 44 connected to each other by spacer member 10. The wound fin tubing shown as tubes 42 is cylindrical in configuration having a slight helical angle as would be formed if the heat exchanger coil were rolled on a drum to form that particular configuration. The openings of the spacer member are offset from each other in the various spacer members to accommodate this helical effect. The partial assembly in FIG. 1 has three spacer members positioned about the heat exchanger coil to secure same. The number and location of the spacer members is a design choice. Typically air will enter the heat exchanger unit and is drawn through the cylindrical heat exchanger coil upwardly and out of the top of the unit. The electrical and refrigerant connections and other components not necessary to the invention herein have not been shown in the drawings.

Figure 2:
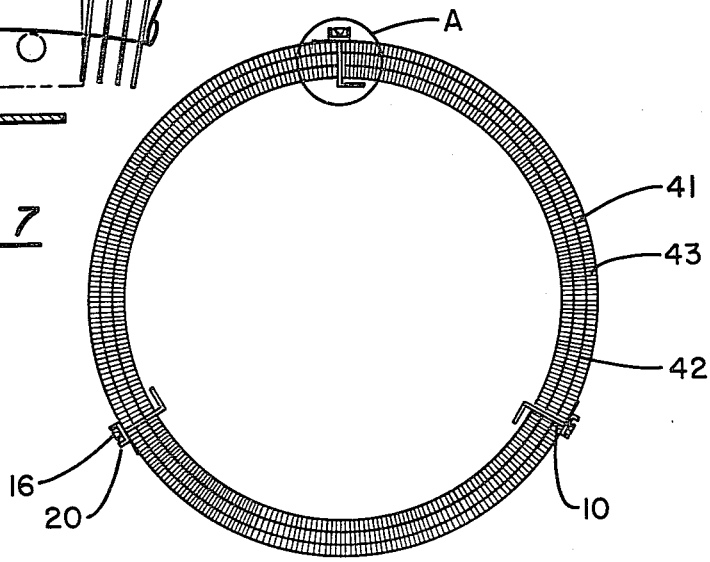
FIG. 2 is a cross sectional view of FIG. 1 taken along line II—II.

The location of the supports may be better ascertained in FIG. 2. FIG. 2 is a cross sectional view of FIG. 1 showing spacer members 10 and retainer elements 20 secured thereto with tab 16. Tubing 42 is shown mounted within the three spaced supports such that it is maintained in an overall cylindrical configuration. It can be further seen in FIG. 2 that the wound fin tubing 42 is depicted having a prime surface tube 41 upon which fins 43 are helically wound to form the heat transfer surface.

Figure 4:
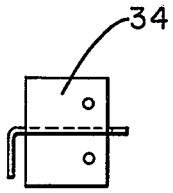
FIG. 4 is an end view of the spacer member.
Figure 3:
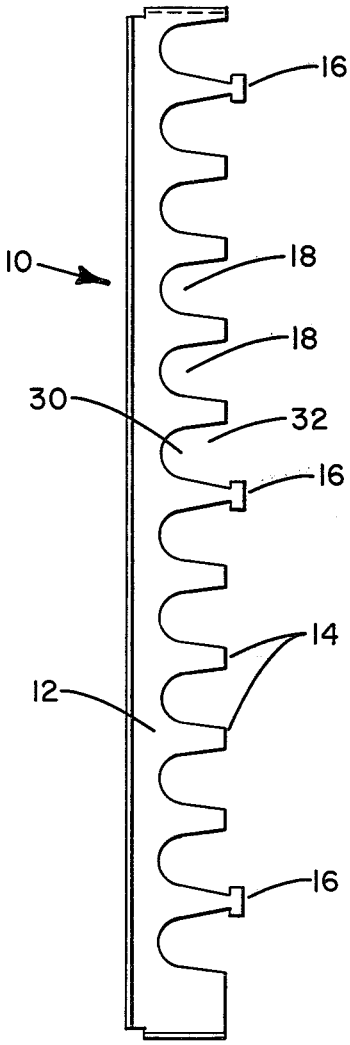
FIG. 3 is a side view of the spacer member described herein.

Referring to FIG. 3 which is the side view of the spacer member it can be seen that spacer member 10 has a structural portion 12 and extending therefrom a series of projections 14. The projections are spaced from each other and define therebetween openings 18 for the receipt of the wound fin tubing. The openings 18 have a circular portion 30 and diverging portion 32. Circular portion 30 is designed to receive the wound fin tubing such that the diameter of the tubing with the fins is greater than the diameter of the circular portion 30 of openings 18 to maintain the wound fin tubing within the openings and to achieve the appropriate spacing for optimum heat transfer efficiency between passes of wound fin tubing secured in successive openings. Since the diameter of the fins on the tube is greater then the diameter of circular portions of the openings, the fins extend beyond the openings. The size of the openings and the diameter of the tubes with the fins are arranged so that there is no more than a minor amount of overlap between fins on successive tube passes. Diverging portion 32 of openings 18 was designed to aid in the insertion of the tubing within the openings. It can be further seen in FIG. 3 that tabs 16 extend in three locations from projections 14. It can be also seen from a combination of FIGS. 3 and 4 that end plates 34 are provided on each end of spacer member 10 such that the spacer member may be secured to the base and top cover.

Figure 6:
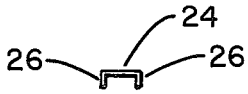
FIG. 6 is an end view of the retainer element.
Figure 5:
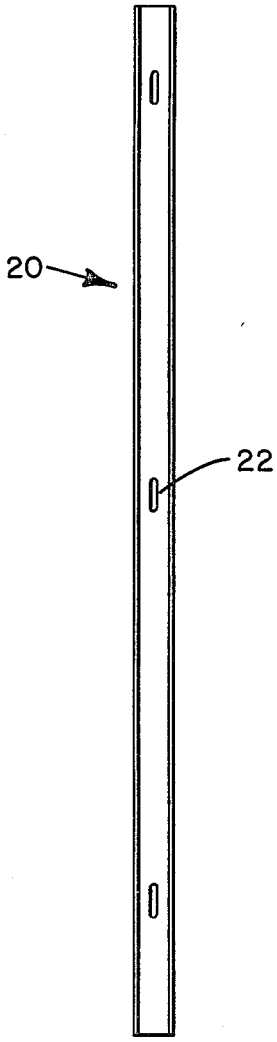
FIG. 5 is a side view of the retainer element described herein.

Referring now to FIGS. 5 and 6 it can be seen that retainer element 20 is a U-shaped beam having slots 22 formed in base portion 24 thereof and legs 26 extending outwardly from the base portion. Slots 22 are designed such that upon the support being assembled tabs 16 extend through slots 22 and may be used to secured the retainer element to the spacer member. Once the retainer element is secured the openings formed by the projections of the spacer member are closed by the retainer element and consequently the wound fin tubing inserted one tube into each opening is fixedly maintained therein. Tabs 16 are twisted after they are inserted through slots 22 to create a mechanical interlock which secures the retainer element to the spacer member.

During assembly of a heat exchanger assembly utilizing the support as described herein, the wound fin coil will first be formed in a cylindrical configuration. Thereafter the spacer members 10 will be arranged with the wound fin coil such that a single pass of the wound fin tube is inserted within each opening. Once all of the tubes are within the openings the retainer element will then be slipped over the tabs to encase openings 18 such that the wound fin tubes are secured one within each opening. Tabs 16 are then twisted to provide for the interlocking of the retainer element to the spacer member. The partial heat exchanger assembly now consisting of the wound fin coil and the supports can then be secured to the base or the top cover. It is within the spirit of this invention to assemble this apparatus in different order or to mount the supports to either the base or the top cover prior to the wound fin coil being inserted therein.

The above invention has been described in reference to a specific embodiment thereof. It is to be understood that variations and modifications can be made within the spirit and scope of the invention.

What is claimed is:

1. A combination support and retainer for heat exchanger assembly utilizing wound fin tubing and having a base and top cover as components thereof which comprises:

a spacer member having a structural portion for securing components of the heat exchanger assembly and a series of spaced projections extending from the structural portion, the projections defining generally U-shaped openings for the receipt of wound fin tubes, at least one of said projections having tab means affixed to the end thereof;

a retainer element for enclosing the U-shaped openings defined by the spaced projections such that a portion of the wound fin tubing may be secured within each opening to maintain a desired spacing therebetween, the retainer element having at least one slot which coacts with the tab means such that the tab means may be twisted relative to the retaining element to securely affix the retainer element to the spacer member to maintain the tubing within the openings.

2. The apparatus as set forth in claim 1 wherein the retainer element is a U-shaped beam, the slots for the receipt of the tabs being located in the base portion of the beam and the legs of the beam extending outwardly in the same directions as the tab before it is twisted.

3. A combination support and retainer for a heat exchanger assembly having a base, a top cover and a heat exchanger coil of wound fin tubing which comprises:

a spacer member connected to the base and the top cover, the spacer member having a structural portion acting to fixedly secure the base and the top cover and having a series of spaced projections therefrom, the projections defining generally U-shaped openings for the receipt of wound fin tubing;

a retainer element for enclosing the U-shaped openings definined by the spaced projections such that the wound fin tubing is secured within the openings to maintain a desired spacing for promoting heat exchange; and tab means affixed to the end of at least one projection, said tab means coacting with slots defined by the retainer element such that the tab means extending from a projection may be inserted through the slot in the retainer element and twisted to secure the retainer element to the spacer member.

* * * * *